United States Patent [19]

Kennedy

[11] Patent Number: 5,010,676

[45] Date of Patent: Apr. 30, 1991

[54] HAND GUARD FOR FIREARMS

[75] Inventor: Paul G. Kennedy, East Hartford, Conn.

[73] Assignee: CFPI Inc., Wilmington, Del.

[21] Appl. No.: 497,128

[22] Filed: Mar. 21, 1989

[51] Int. Cl.[5] ..... F41C 23/16

[52] U.S. Cl. ..... 42/71.010

[58] Field of Search ..... 42/71.01

[56] References Cited

U.S. PATENT DOCUMENTS

| | | | |
|---|---|---|---|
| 1,415,919 | 5/1922 | Butler et al. . | |
| 1,487,214 | 3/1924 | Dezendorf . | |
| 1,487,312 | 3/1924 | Bull . | |
| 1,939,700 | 12/1933 | Hofstetter . | |
| 2,442,382 | 6/1948 | Sleg . | |
| 2,791,155 | 5/1957 | Thiel . | |
| 2,916,970 | 12/1959 | Mutter . | |
| 3,018,694 | 1/1962 | Browning . | |
| 3,075,314 | 1/1963 | Bakker | 42/71.01 |
| 3,090,150 | 5/1963 | Stoner . | |
| 3,155,003 | 11/1964 | Ruth . | |
| 3,164,060 | 1/1965 | Dahl . | |
| 3,367,055 | 2/1968 | Powell . | |
| 3,665,804 | 5/1972 | Rohr . | |
| 3,710,683 | 1/1973 | Kaltmann . | |
| 4,536,982 | 8/1985 | Bredbury et al. | 42/71.01 |
| 4,663,875 | 5/1987 | Tatro | 42/71.01 |
| 4,663,876 | 5/1987 | Reaume | 42/71.01 |

FOREIGN PATENT DOCUMENTS

| | | | |
|---|---|---|---|
| 546750 | 10/1959 | Belgium | 42/71.01 |

*Primary Examiner*—Deborah L. Kyle
*Assistant Examiner*—Richard W. Wendtland
*Attorney, Agent, or Firm*—Perman & Green

[57] ABSTRACT

A hand guard removably mountable on the barrel of a firearm such as a rifle. The hand guard is formed in two complementary mating housing components joined in a vertical plane which contains the longitudinal axis of the barrel. The housing components together define a convection chamber which envelops a substantial length of the barrel of the firearm. The joined housing components are generally of pear-shaped cross section having a broadened, flattened bottom member and a narrow, tall chimney member. Heat from the barrel of the firearm creates convection currents in the convection chamber as cooling air is drawn through inlet ports in the bottom member, around the barrel, and out through exhaust ports in sidewalls of the chimney member. A heat shield is carried by each of the housing components and is positioned between the barrel and the outer housing.

21 Claims, 2 Drawing Sheets

HAND GUARD FOR FIREARMS

BACKGROUND OF THE INVENTION

1. Field of the Invention

The present invention relates to a hand guard for various types of firearms but, more particularly, to a hand guard adapted to be utilized in conjunction with the barrels of such rapid firing weapons as rifles, carbines, and the like. The purpose of the hand guard is to insulate the hand of the user of such firearms from the heat generated by their barrels.

2. Description of the Prior Art

It is well known to those skilled in the art that rapid fire weapons utilized particularly in military operations are characterized by the heating of the barrels thereof to relatively high temperatures. At such temperatures, the barrels cannot be comfortably, and indeed, safely held by the soldier firing the same. Various expedients have been resorted to in the past in an attempt to insulate the hand of the person firing the weapon from harmful contact with the excessively hot barrel while still permitting adequate cooling of the barrel to such an extent as to prevent the rise in temperature of the barrel which might possibly cause malfunctioning of the firearm.

U.S. Pat. No. 3,090,150 to Stoner is representative of known hand guard constructions which utilize a housing encompassing a substantial length of the barrel of the firearm. Apertures are provided both along the bottom and along the top of the housing. The heat of the barrel creates convection currents within the interior of the housing which cause ambient air to be drawn in through the bottom apertures and then cause it to be discharged through the top apertures. Unfortunately, the heated air is discharged along the line of sight resulting in visual distortion and adversely affecting the ability of the user of the firearm to fire accurately.

SUMMARY OF THE INVENTION

It is with the foregoing in mind that the hand guard of the invention has been conceived and reduced to practice. The hand guard of the invention is removably mountable on the barrel of a firearm such as a rifle. The hand guard is formed in two complementary mating housing components joined in a vertical plane which contains the longitudinal axis of the barrel. The housing components together define a convection chamber which envelops a substantial length of the barrel of the firearm. The joined housing components are generally of pear-shaped cross section having a broadened, flattened bottom member and a narrow, tall chimney member. Heat from the barrel of the firearm creates convection currents in the convection chamber which draw ambient air into the convection chamber through inlet ports in the button member, around the barrel, and out through exhaust ports in sidewalls of the chimney member. A heat shield is carried by each of the housing components and is positioned between the barrel and the outer housing.

It is, therefore, an object of my invention to provide a hand guard for firearms of the aforementioned construction which is characterized by the fact that it is of extremely light weight, has a minimum number of component parts, and achieves the desired ends of providing adequate cooling for the barrel of the firearm and eliminating the possibility of injury to the hand of the user, without compromising accuracy. At the same time, the hand guard is comfortable for the user of the firearm and enables existing firearms to be retrofitted in the field.

Primarily responsible for the achievement of these desirable ends is the fact that the hand guard of the invention is characterized by induced air cooling of the barrel resulting from the utilization of heated air to cause the aspiration of cooling air past the barrel and through an air insulated chamber which isolates the barrel from contact with the hand of the user of the gun. A particularly important feature resides in the construction of the chimney member which has exhaust ports in the sidewalls, thereby routing flow of the heated air away from the user's line of sight. Also, the hand guard of the invention is provided with an elongated sight groove which is coincident with the normal line of sight of the firearm.

It is a further object of my invention to provide a hand guard of the aforementioned character which includes an air insulated chamber and a barrel receiving chamber, the air insulated chamber being divided into two parts on opposite sides of the barrel receiving chamber.

Another object of my invention is to provide a hand guard of the aforementioned character wherein both the air insulated chamber and the barrel receiving chamber are in communication with air inlet and exhaust ports providing for the flow of cooling air through both of the chambers.

A further object of my invention is the provision of a hand guard of the aforementioned character wherein the heated air generated in the barrel receiving chamber of the hand guard flows through and out of the barrel receiving chamber to induce the flow of cooling air both into the barrel receiving chamber and through the air insulated chamber surrounding the barrel receiving chamber.

Another object of my invention is the provision of a hand guard of the aforementioned character which is characterized by the ease with which it may be mounted upon and dismounted from, operative engagement with the barrel of a firearm with which it is associated. The ease in mounting and dismounting the hand guard of my invention upon or from the barrel firearm is attributable to the fact that it is provided with positioning and mounting devices adapted to cooperate with corresponding portions of the firearm at both its muzzle end and at its breech end, respectively, so that the hand guard may be easily mounted and dismounted from operative association with the barrel.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and, together with the description, serve to explain the principles of the invention in general terms. Like numerals refer to like parts throughout the disclosure.

DETAILED DESCRIPTION OF THE PREFERRED EMBODIMENT

Figure 1:
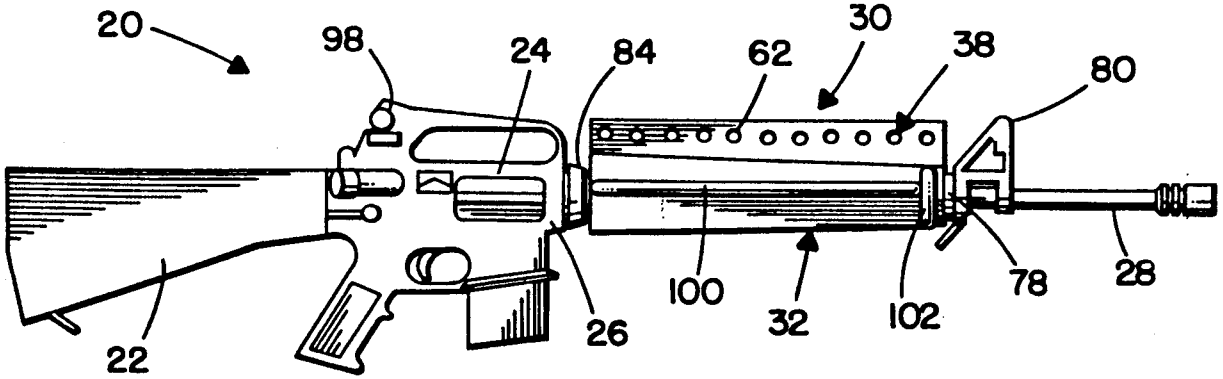
FIG. 1 is a side elevation view of a firearm modified to include a hand guard of the invention.

Turn now to the drawings and, initially, to FIG. 1 which illustrates a firearm 20 in the form of a rifle incorporating a stock 22 and a receiver 24 mounted on a forward extremity of the stock. The receiver 24 has a protruding portion 26 adapted to receive the rear extremity of a barrel 28. In typical fashion, the barrel can be described as extending between a breech end adjacent the protruding portion 26 and a muzzle, or distal, end.

Mounted in encompassing relationship with the barrel 28 is a hand guard 30 being constituted by first and second mating parts 32, 34, which, when joined in operative and mating relationship with each other define a housing which is generally of a pear-shaped cross section having a broadened, flattened, bottom member 36 and a narrow, tall chimney member 38 with a pair of spaced substantially vertically disposed sidewalls 40 and opposed connecting members 42 uniting the bottom member 36 and the sidewalls 40. The hand guard 30 may be composed of an injection molded 4/6 nylon material supplied by Allied Chemical Corporation, or other suitably thermoplastic material.

The hand guard 30 serves to protect the user of the firearm 20 against the substantial heat generated in the barrel 28 as a result of rapid firing. The housing of the hand guard has a longitudinal axis which is substantially aligned with the longitudinal axis of the barrel 28 when it assumes its normally mounted position. The housing of the hand guard, which may be of aluminum or other suitable sheet material, defines a convection chamber 44 therein and a heat shield 46 is mounted to each mating part 32, 34 of the hand guard and positioned within the convection chamber. A plurality of spaced parallel ribs 48 are formed on the inner surface of each of the mating parts 32, 34 within the convection chamber 44 and these ribs are provided with spaced apart slots 50, 52 (FIG. 4) for receiving mating tabs 54 integral with the heat shield.

Figures 3, 4, 5, 6:
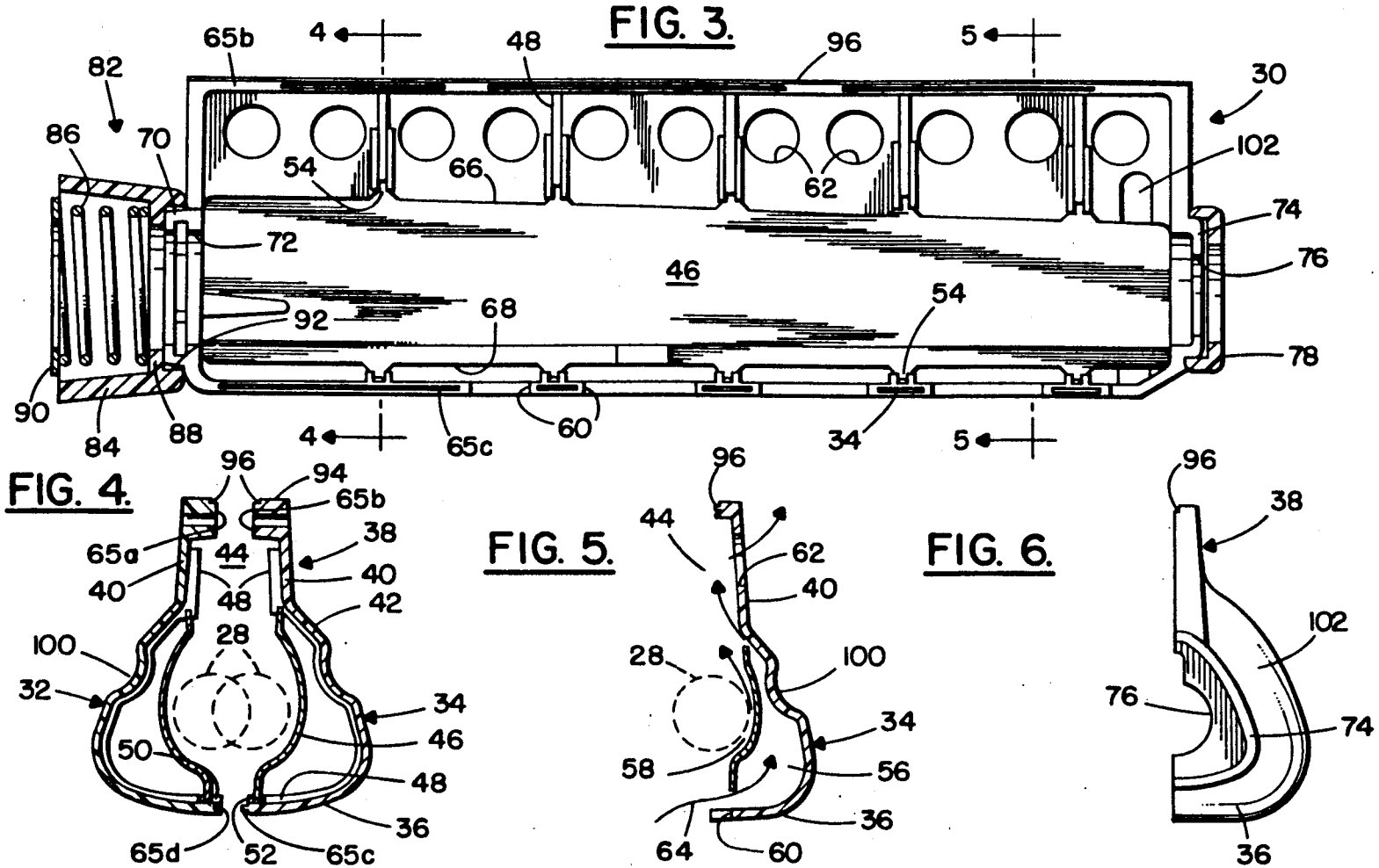
FIG. 3 is a side elevation view of one of the mating parts of the FIG. 2 construction, certain parts of the firearm itself being cut away and shown in section.
FIG. 4 is a cross section view taken generally along line 4—4 in FIG. 3 illustrating both mating parts of the hand guard.
FIG. 5 is a cross section view taken generally along line 5—5 in FIG. 3.
FIG. 6 is an end elevation view illustrating the hand guard of the invention as seen from its muzzle end.

As seen in FIGS. 4 and 5, each heat shield 46 is positioned intermediate the gun barrel 28 and its associated mating part 34 to thereby define an outer path 56 for air flow and an inner path 58. The housing defined by the mating parts 32, 34 is formed with a plurality of longitudinally spaced inlet ports 60 in the bottom member 36 and a plurality of longitudinally spaced exhaust ports 62 are formed in each of the sidewalls 40.

The airflow pattern through the convection chamber 42 is graphically illustrated in FIG. 5 by means of arrows 64. These arrows illustrate the ingress of air through the inlet ports 60 and into the convection chamber 44. As the air flows upwardly around the barrel 28, it is heated and thus caused to rise more quickly and continues to rise until it flows out of the exhaust ports 62. At the same time as the cool air flows inwardly through the inlet ports 60 via inner path 58, air flow is induced into the outer path 56, being drawn upwardly by the aspirative effect of the large mass of air passing over the barrel 18 via the inner path.

It can be readily seen, therefore, that the spacing of upper and lower edges 66, 68 of the heat shield 46 serve the useful purpose of permitting communication of cooling air with the inner path 58 while causing the induced flow of the cooling air through the outer path 56 by the aspirative effect of barrel heated air flowing through the exhaust ports 62. The sheet metal of which the heat shield 46 is formed may be provided with a highly reflective inner surface which serves to prevent undue heat radiation onto the mating parts 32, 34. In this way, the heat energy is reflected back into the rapidly flowing, convective air streams flowing through the inner path 58 between the inlet port 60 and the exhaust port 62.

Each of the mating parts, 32, 34 includes a substantially continuous rim 65*a*, 65*b* which are mutually congruent such that when they are joined together, they mutually define the convection chamber 44. Integral elongated key members 65*c* engage with complementary slots 65*d* to assure the proper relative positioning of the mating parts 32, 34 when they are assembled.

The hand guard 30 can be readily attached to the firearm 20 and detached therefrom, even in combat. In order to facilitate the mounting of the mating parts 32, 34 in operative and encompassing relationship with the barrel 28, each of the mating parts is provided with corresponding semi-circular projections 70 at the breech end which define an opening 72 for free reception therethrough of the barrel 28 and ovoid-shaped projections 74 at the muzzle end similarly defining a barrel receiving opening 76. In order to mount the mating parts 32, 34 in operative engagement with the barrel 28, it is merely necessary to insert the projections 74 into the interior of a similarly contoured cup shaped muzzle mounting member 78 which is fixed to the barrel 28 adjacent a stationary fore sight member 80.

Figure 2:
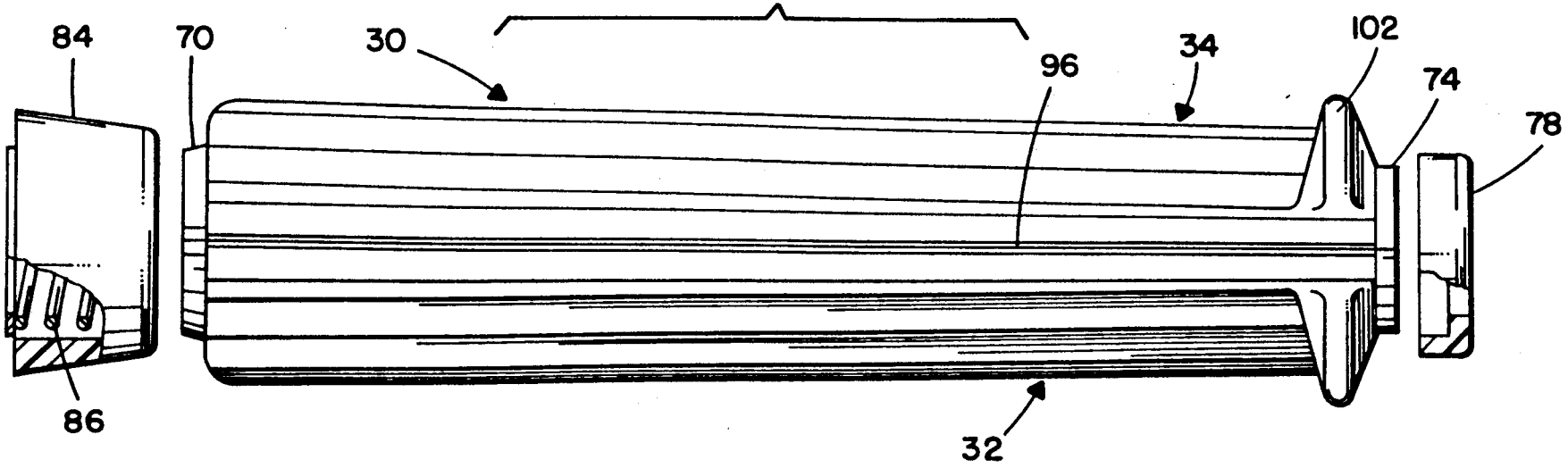
FIG. 2 is a top plan, exploded, view of a part of FIG. 1, primarily illustrating the hand guard of the invention, certain parts of the firearm itself being cut away and shown in section.

Adjacent the protruding portion 26 of the receiver 24, the firearm 20 is provided with a mechanism for releasably mounting the hand guard 30 at the breech end of the barrel 28. The mounting mechanism 82 is constituted by a longitudinally shiftable annular collar 84. A compression coil spring 86 is interposed between an annular land 88 on the collar and a spring seat 90 fixed to the protruding portion 26. The normal bias of the spring 86 serves to urge the collar 84 forwardly, or to the right, as viewed in FIG. 3 of the drawings. Thus, after the projections 74 of the mating part 32, 34 have been introduced into engagement with the muzzle mounting member 78, the mating parts 32, 34 are moved into mating engagement such that their rims are proximately disposed. The annular collar 84 is then withdrawn against the bias of spring 86 to the position illustrated in FIG. 2, then released to the position illustrated in FIG. 3 to enable a circular recess 92 in the end of the collar 84 and adjacent the annular land 88 to receive therein the projections 70. When this occurs, the breech end of the hand guard 30 is locked in position on the barrel 28 of the firearm 20. To remove the hand guard from the barrel 28, the procedure just described is reversed.

The hand guard 30 incorporates a number of other features which are further enhancements to its use. For example, the tall chimney member 38 which, with its exhaust ports 62, is effective to cool the barrel 28 by way of the convection currents developed within the chamber 44, terminates in a bridge member 94 which joins the sidewalls 40 when the mating parts 32, 34 are joined together. The bridge member 94 is formed with a longitudinally extending groove 96 which is generally aligned with the fore sight 80, previously mentioned, and with an aft sight 98 provided on the receiver 24. In this manner, the hand guard 30 is also effective to improve the accuracy of the firearm 20.

As previously noted, the bottom member 36 is of broadened form relative to the chimney member 38, being shaped to comfortably receive the palm of the user's hand. In addition, a longitudinal thumb and finger receiving groove 100 is provided in the region of the connecting members 42 and further improves the ability of the user to grip the firearm.

Additionally, a protective flange 102 is provided at the muzzle end of the hand guard 30 and projects radially outwardly from the outer surface thereof. Its purpose is to prevent accidental movement of the user's hand longitudinally of the hand guard beyond its muzzle end to prevent its touching the hot barrel 28. The flange thus provides a barrier to prevent inadvertent harm to the user of the firearm.

Because of the substantial heat generated in the barrel 28 at its muzzle end, it may be desirable for the projections 74 to be of a more heat resistant material than the remainder of the hand guard. For example, the projections 74 may be composed of compression molded thermal set material, Catalog No. 8130E supplied by Fiberite Corporation of Winona, Wis. or other suitable material. In the instance, it would be incorporated into the injection mold of the hand guard 30 so as to become one with the finished product.

While a preferred embodiment of the invention has been disclosed in detail, it should be understood by those skilled in the art that various other modifications may be made to the illustrated embodiments without departing from the scope of the invention as described in the specification and defined in the appended claims.

What is claimed is:

1. A hand guard for the barrel of a firearm comprising:

an elongated housing adapted to be mounted on the barrel for encapsulating a predetermined length of the barrel and defining a convection chamber therein;

said housing having a longitudinal axis substantially aligned with the longitudinal axis of the barrel;

said housing being generally of pear-shaped cross section having a broadened, flattened, bottom member, a narrow, tall chimney member with a pair of spaced substantially vertically disposed sidewalls, and a transversely extending bridge member joining said sidewalls, and opposed connecting members uniting said bottom member and said sidewalls;

said housing having a plurality of longitudinally spaced inlet ports formed in said bottom member and a plurality of longitudinally spaced exhaust ports in each of said sidewalls;

whereby heat from the barrel of the firearm creates convection currents in said convection chamber which draw ambient air into said convection chamber through the inlet ports, around the barrel, and out through the exhaust ports, thereby cooling the barrel and directing the heated air away from said bridge member.

2. A hand guard as set forth in claim 1 including:

heat shield means mounted to said housing within said convection chamber generally intermediate the barrel and said connecting members to thereby define an outer path for cooling air between said heat shield means and said housing and an inner path for the cooling air between the barrel of the firearm and said heat shield means.

3. A hand guard as set forth in claim 2 including means for supporting said heat shield means on said housing at longitudinally spaced locations within said convection chamber.

4. A hand guard as set forth in claim 3 wherein said supporting means includes:

a plurality of spaced parallel ribs on said housing within said convection chamber, each of said ribs having spaced apart slots therein; and a plurality of spaced apart tabs integral with said heat shield means engageable with said slots.

5. A hand guard as set forth in claim 1 wherein said chimney member includes a longitudinally extending sight groove in said bridge member generally aligned with fore and aft sights of the firearm when mounted thereon.

6. A hand guard as set forth in claim 1 wherein said connecting member includes a longitudinally extending finger receiving groove.

7. A hand guard as set forth in claim 1 wherein said housing has first and second mating parts including first and second substantially continuous rims, said first and second rims being mutually congruent such that when they are joined together, said first and second mating parts together define said convection chamber.

8. A hand guard as set forth in claim 7 including:

complementary mating means on said first and second rims for relatively positioning said first and second mating parts.

9. A hand guard as set forth in claim 1 wherein said housing extends between a muzzle end and a breech end, has an outer surface, and at said muzzle end includes a radially outwardly extending flange for protecting the hand of an operator.

10. A hand guard as set forth in claim 1 including:

means for mounting said housing on the firearm.

11. A hand guard as set forth in claim 10 wherein said mounting means includes:

first mounting means at the muzzle end of the barrel; and second mounting means at the breech end of the barrel.

12. A hand guard as set forth in claim 11 wherein said first mounting means includes:

a cup-shaped muzzle mounting member fixed to the barrel; and fore projections on said housing for mounting reception with said muzzle mounting member; and wherein said second mounting means includes:

an annular collar mounted on the firearm for movement between first and second positions;

resilient means biasing said annular collar toward said second position; and aft projections on said housing;

said collar being engaged with said aft projections when it assumes said second position.

13. In combination:

a firearm including:

a barrel having a longitudinal axis and extending between a muzzle end and a breech end distant from said muzzle end;

first mounting means at the muzzle end of said barrel; and second mounting means at the breech end of said barrel;

an elongated housing extending between first and second ends and including a first mounting member at said first end releasably engageable by said first mounting means and a second mounting member at said second end releasably engageable by said second mounting means to thereby encapsulate a predetermined length of said barrel and defining a convection chamber therein;

said housing having a longitudinal axis substantially aligned with the longitudinal axis of said barrel;

said housing being generally of pear-shaped cross section having a broadened, flattened, bottom member, a narrow, tall chimney member with a pair of spaced substantially vertically disposed sidewalls, and a transversely extending bridge member joining said sidewalls, and connecting members uniting said bottom member and each of said sidewalls;

said housing having a plurality of longitudinally spaced inlet ports formed in said bottom member and a plurality of longitudinally spaced exhaust ports in each of said sidewalls;

whereby heat from said barrel creates convection currents in said convection chamber which draws ambient air into said convection chamber through the inlet ports, around said barrel, and out through the exhaust ports, thereby cooling said barrel and directing the heated air away from said bridge member.

14. The combination as set forth in claim 13 heat shield means mounted to said housing within said convection chamber generally intermediate the barrel and said connecting members to thereby define an outer path for cooling air between said heat shield means and said housing and an inner path for the cooling air between the barrel of the firearm and said heat shield means.

15. The combination as set forth in claim 14 including means for supporting said heat shield means on said housing at longitudinally spaced locations within said convection chamber.

16. The combination as set forth in claim 15 wherein said supporting means includes:

a plurality of spaced parallel ribs on each housing within said convection chamber, each of said ribs having spaced apart slots therein; and a plurality of spaced apart tabs integral with said heat shield means engageable with said slots.

17. The combination as set forth in claim 13 wherein said chimney member includes a longitudinally extending sight groove in said bridge member generally aligned with fore and aft sights of the firearm when mounted thereon.

18. The combination as set forth in claim 13 wherein said connecting member includes a longitudinally extending finger receiving groove.

19. The combination as set forth in claim 13 wherein said housing has first and second mating parts including first and second substantially continuous rims, said first and second rims being mutually congruent such that when they are joined together, said first and second mating parts together define said convection chamber.

20. The combination as set forth in claim 19 complementary mating means on said first and second rims for relatively positioning said first and second mating parts.

21. The combination as set forth in claim 13 wherein said housing has an outer surface and at said first end includes a radially outwardly extending flange for protecting the hand of an operator.

* * * * *